US009427018B2

(12) United States Patent
Nunes De Oliveira et al.

(10) Patent No.: US 9,427,018 B2
(45) Date of Patent: Aug. 30, 2016

(54) EQUIPMENT FOR TOBACCO TREATMENT OR ANOTHER BULK MATERIAL SENSITIVE TO MECHANICAL STRESS

(71) Applicant: SOUZA CRUZ S.A., Rio de Janeiro (BR)

(72) Inventors: Geraldo Henrique Nunes De Oliveira, Rio Grande do Sul (BR); Gilson Rufino Sant'anna, Rio Grande do Sul (BR); Carlos Adriano Costa Urbano, Rio Grande do Sul (BR)

(73) Assignee: Souza Cruz, S.A., Rio de Janeiro (BR)

( * ) Notice: Subject to any disclaimer, the term of this patent is extended or adjusted under 35 U.S.C. 154(b) by 0 days.

(21) Appl. No.: 14/429,609

(22) PCT Filed: Oct. 16, 2013

(86) PCT No.: PCT/IB2013/059380
§ 371 (c)(1),
(2) Date: Jun. 26, 2015

(87) PCT Pub. No.: WO2014/060955
PCT Pub. Date: Apr. 24, 2014

(65) Prior Publication Data

US 2015/0327591 A1 Nov. 19, 2015

(30) Foreign Application Priority Data

Oct. 16, 2012 (BR) ..... 10 2012 026524 9

(51) Int. Cl.
*A24B 3/04* (2006.01)
*A24B 3/12* (2006.01)

(52) U.S. Cl.
CPC .. *A24B 3/04* (2013.01); *A24B 3/12* (2013.01)

(58) Field of Classification Search
USPC ..... 131/305; 34/58, 108
See application file for complete search history.

(56) References Cited

U.S. PATENT DOCUMENTS

| | | | | |
|---|---|---|---|---|
| 3,906,961 | A | 9/1975 | Rowell et al. | |
| 6,155,269 | A | 12/2000 | Franke et al. | |
| 6,286,515 | B1 | 9/2001 | Wagoner | |
| 2008/0202993 | A1* | 8/2008 | Eley | C12M 21/16 210/130 |

FOREIGN PATENT DOCUMENTS

| | | | |
|---|---|---|---|
| CN | 201094273 | Y | 8/2008 |
| CN | 201995563 | U | 10/2011 |
| EP | 0917828 | A2 | 5/1999 |
| GB | 2264354 | A | 8/1993 |
| WO | 89/08407 | A1 | 9/1989 |

OTHER PUBLICATIONS

International Search Report and Written Opinion, mailed Apr. 4, 2014 for PCT/IB2013/059380, filed Oct. 16, 2013.
International Preliminary Report on Patentability, mailed Nov. 4, 2014 for PCT/IB2013/059380, filed Oct. 16, 2013.

* cited by examiner

*Primary Examiner* — Dennis Cordray
(74) *Attorney, Agent, or Firm* — McKee, Voorhees & Sease, PLC

(57) ABSTRACT

Equipment for treatment of tobacco or another bulk material sensitive to mechanical stress, the equipment having: (i) a rotatable treatment drum with a material inlet and a material outlet; (ii) a treatment fluid inlet; (iii) a treatment fluid excess outlet; (iv) a drive motor for the rotatable treatment drum; and (v) a temperature sensor.

12 Claims, 2 Drawing Sheets

EQUIPMENT FOR TOBACCO TREATMENT OR ANOTHER BULK MATERIAL SENSITIVE TO MECHANICAL STRESS

CLAIM FOR PRIORITY

This application is the National Stage of International Application No. PCT/IB2013/059380, filed Oct. 16, 2013, which in turn claims priority to an benefit of Brazilian Patent Application No. BR 2012 026524 9, filed Oct. 16, 2012. The entire contents of the aforementioned application are herein expressly incorporated by reference.

FIELD OF THE INVENTION

The present invention relates to an apparatus for various types of treatment for tobacco or another bulk material sensitive to mechanical stress, like tobacco leaves with low moisture content.

BACKGROUND OF THE INVENTION

It is known from the art conditioning cylinders employed in the mixing, steam conditioning, drying and applying of flowing material to a bulk material, for example, tobacco, to be treated. Such cylinders are placed with its input end elevated in relation to the output end and are rotated around the longitudinal geometric axis usually at about fifteen revolutions per minute. Thus, the material to be treated enters one end of the cylinder (inlet end) and, given that the cylinder is in tilted position, by force of gravity the material moves and leaves already treated through the other end (outlet end) in a continuous flow process.

One of the materials that is sensitive to mechanical stress is pre-treated tobacco, for example, cured tobacco or expanded tobacco, which presents low moisture content and require reconditioning. Consequently, it is necessary to increase the moisture content of such materials to a value within the range of 12 a 16%, usually by the employment of water steam. This increase in moisture content makes the tobacco more flexible and less liable to break during subsequent process operations for the manufacture of tobacco based products. However, it is logical that the moisture operation should be performed in conditions which ensure a uniform distribution of moisture in the material and imply minimum degradation of such material.

Generally, conditioning processes and other tobacco treatments (such as, for example, fixing added ingredients, volatilizing undesired substances etc.) require a temperature increase to render the treatment more effective. Such heating is one of the many conditions that can lead to unwanted changes in tobacco physical characteristics, for example, fragmentation.

For example, in patent U.S. Pat. No. 6,286,515, it is disclosed a moistening cylinder comprising (i) a first rotating cylinder having an input end and an output end and a plurality of blades extending radially from the outer surface of the first cylinder; (ii) a second rotating cylinder also having an input end and an output end and a plurality of blades extending radially from the inner surface of the second cylinder, wherein both cylinders are arranged coaxially with the first cylinder in the interior of the second cylinder, defining an annular space where the material is treated; (iii) a motor for driving both coaxial cylinders and tubes placed in the annular space for moisture introduction. Such apparatus, however, has elements that can damage the material being treated, for example, the two set of blades which, jointly with the rotation movement of the cylinders, cause continuous falls of the material from a set of blades to the other set, implying in damage to the material sensitive to mechanical stress.

Therefore, is evident the need of an apparatus which allows tobacco treatment or another bulk material sensitive to mechanical stress, in an efficient manner without, however, impairing the integrity of the material being treated.

SUMMARY OF THE INVENTION

The invention is embodied in form of equipment (1) for treatment of bulk material sensitive to mechanical stress comprising:

(i) a treatment rotating drum (2), composed by an inlet (3) and an exit (4) of the material to be treated;
(ii) a treatment fluid inlet (5);
(iii) a treatment fluid excess outlet (7);
(v) a drive motor (11) for the rotating drum;
(vi) a temperature sensor (12).

More preferably the invention is embodied in form of equipment (1) for treatment of bulk material sensitive to mechanical stress comprising: (i) a treatment rotating cylinder (2), preferably of thermal treatment, provided with an inlet (3) and an exit (4) of material to be treated; (ii) a treatment fluid inlet (5), preferably of water steam, said inlet being provided with a flow regulation device (6), preferably a valve; (iii) a treatment fluid excess outlet (7), for example, of condensed steam (purger); (iv) a support structure (8) of said treatment rotating cylinder with a substantially horizontal geometric axis (9), and said support structure (8) being preferably provided with casters (10) for movement of said equipment to different areas; (v) drive motor (11) of said rotating cylinder, preferably at a velocity of about 2 to about 30 rpm; (vi) a sensor (12) for controlling the temperature of said treatment, preferably within the range of about 20 to about 120° C.; (vii) a control panel (13) for monitoring the treatment conditions, such as rotation velocity of the rotating cylinder, temperature, moisture content inside the rotating cylinder, treatment time; (viii) inlet and exit sealing ports (14) of the material to be treated; (ix) tube (15) placed inside the rotating cylinder (2), for example, a coil, for the circulation of treatment fluid; and (x) thermal insulation cover (16) around the rotating cylinder, wherein the treatment time, temperature and moisture content set of parameters is such that ensures the efficiency of the treatment without causing mechanical damage or of other sort to the sensitive material being treated.

DETAILED DESCRIPTION OF THE INVENTION

Figure 1A:
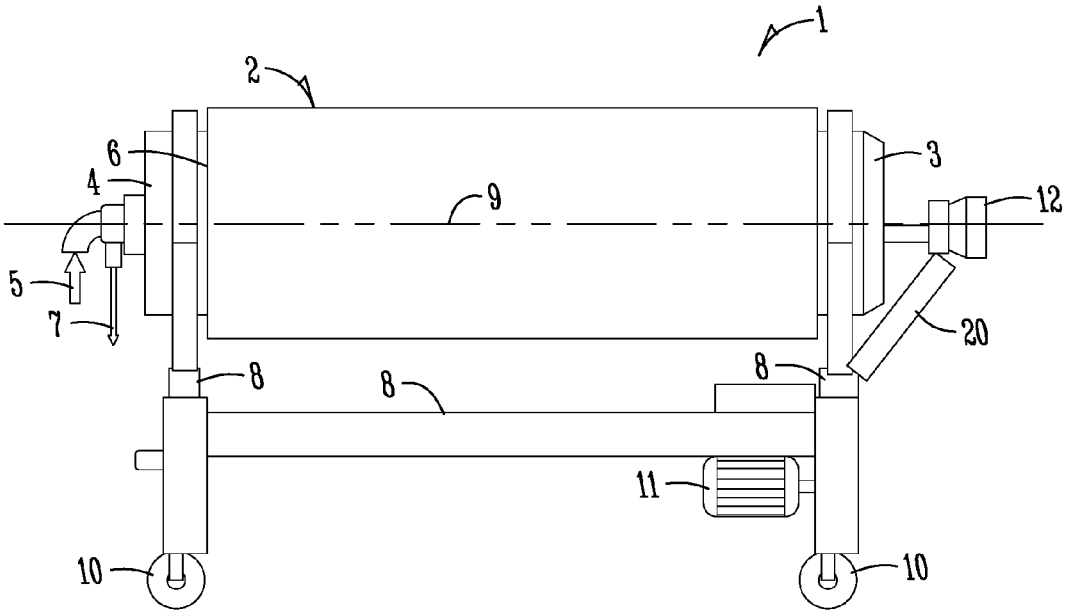
FIG. 1A is a side elevation view of the whole apparatus of the present invention.
Figure 1B:
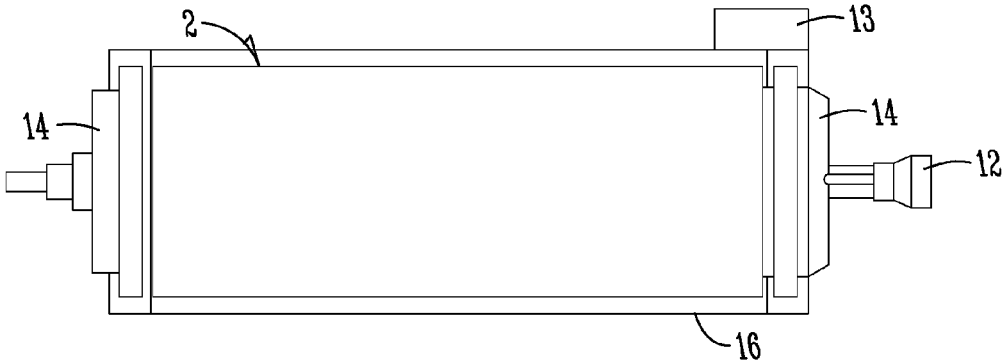
FIG. 1B illustrates the detail of the treatment cylinder of the apparatus.

The apparatus (1) of the present invention, as presented in FIGS. 1A and 1B comprising a rotating cylinder (2) that is driven by a motor (11) during operation. The material to be treated is introduced by the inlet end (3) and remains in the cylindrical space during a period of time sufficient for completion of said treatment. As the cylinder (2) is rotated at an appropriate velocity, preferably within the range of 2 to 30 rpm, further preferably within the range of 2 to 20 rpm, the material is revolved gently, in conditions in which practically no damage occurs. The treatment fluid, which, in the case a moistening process, can be selected from steam, water or air with high moisture content, is introduced through the tube (5), preferably by means of a regulation device (6), for example, a rotating valve or, alternatively, the treatment fluid can be applied to the material being treated by an additional sprinkler nozzle. In other embodiments for an alternative treatment, the treatment fluid can be circulated inside the rotating cylinder (2) through the tubing in a closed circuit (15). The whole equipment body is made of stainless steel. After an appropriate period of time for the type of treatment, for example, from about 10 minutes to about 80 hours, preferably from about 30 to about 60 hours, the material is removed from the rotating cylinder by the exit end (4).

The equipment (1) of the invention is operated non-continuously. This way, the cylinder (2) is provided with containment ports in the loading and unloading ends thereof. The equipment (1) is also provided with a hydraulic system (20) for elevation of the loading end in order to facilitate the loading and unloading operations, given that the treatment is preferably performed in the horizontal position.

The rotating cylinder (2) is arranged on top of a support structure (8), which also serves as a base for coupling of the drive motor (11). The disposition of the rotating cylinder (2) is such that the geometric axis (9) thereof is substantially horizontal. Also preferably, the structure (11) is provided with casters (10) that allow the movement of the apparatus to a required place. The rotating cylinder is further provided with lids (14), preferably of transparent material, for example, polycarbonate or glass etc., for sealing the inlet and exit ports of material in such way that, during operation, leakproofing of the treatment environment is ensured.

The equipment (1) of the present invention can be operated at room temperature, but is preferably operated at a temperature that may vary from room temperature to 120° C. Thus, the equipment (1) is provided with a sensor (12) for treatment temperature control. The invention equipment (1) is also equipped with a control panel (13) for monitoring the conditions to which the material is being subjected, such as rotation velocity of the rotating cylinder (2), treatment fluid flow, treatment time, temperature etc.

Figure 2:
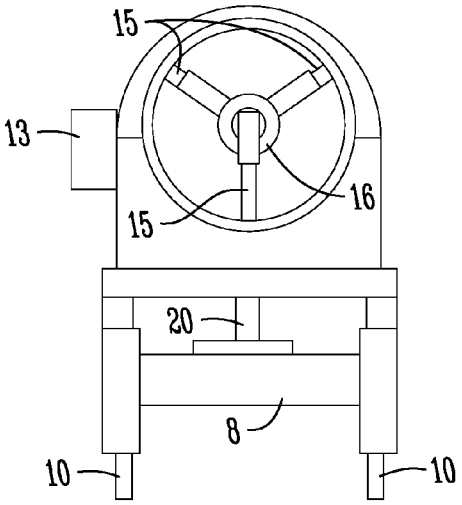
FIG. 2 is a front view of the apparatus of the present invention, showing the treatment fluid circulation inside the rotating cylinder.

In FIG. 2, is possible to see the tubing arrangement (15), for example, coil, for circulation of the treatment fluid, preferably steam.

Figure 3:
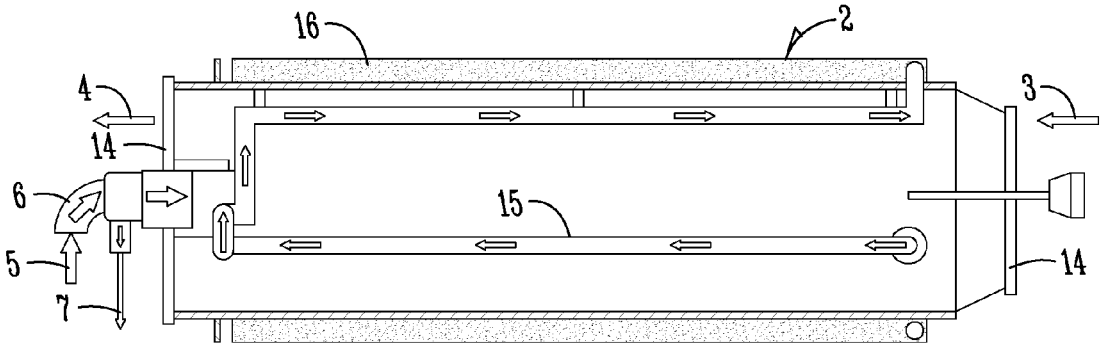
FIG. 3 is a side view of the apparatus rotating cylinder of the present invention showing in its interior the treatment fluid circulation tube.

In FIG. 3, is shown in details the localization of the temperature sensor (12), the tubing arrangement (15) for circulation of the treatment fluid and the thermal insulation cover (16) for maintaining an appropriate treatment temperature inside the rotating cylinder (2).

Although certain embodiments have been described, they are only presented as exemplary modes and do not have the intention of limiting of scope of the invention. Indeed, the new embodiments described herein can be accomplished in a variety of other forms; further, many omissions, substitutions and changes in the form of the embodiments described herein can be done without departing from the essence of the invention. The claims accompanying the description and their equivalents are considered to cover such forms or changes in that they can be within the scope and spirit of the invention.

The invention claimed is:

1. Equipment for treatment of tobacco or another bulk material sensitive to mechanical stress, said equipment comprising:

(i) a rotatable treatment drum disposed on support structure such that a geometric axis thereof is substantially horizontal, and having an inlet end comprising a material inlet, and a material outlet, and the inlet end having an adjustable elevation via the support structure to aid in loading and/or unloading of the rotatable treatment drum;

(ii) a treatment fluid inlet for a treatment fluid;

(iii) a treatment fluid excess outlet;

(iv) a temperature sensor;

wherein the equipment is configured for non-continuous operation and the rotatable treatment drum is configured to be rotated at a velocity within the range of 2 rpm to 20 rpm;

wherein said support structure includes a hydraulic system for adjusting the elevation of the inlet end, and wherein the support structure is movable.

2. The equipment according to claim 1, further comprising:

(vi) the support structure of said rotatable treatment drum coupling the drive motor to the rotatable treatment drum;

(vii) a control panel:

(viii) sealing ports for the material inlet and the material outlet;

(ix) tubes disposed in an interior of the rotatable treatment drum; and (x) a thermal insulation cover disposed around the rotatable treatment drum.

3. The equipment according to claim 1, wherein the equipment is configured to thermally treat a material received therein.

4. The equipment according to claim 1, wherein said treatment fluid is steam.

5. The equipment according to claim 1, wherein said treatment fluid inlet is through a flow regulating device.

6. The equipment according to claim 5, wherein said flow regulating device is a valve.

7. The equipment according to claim 1, wherein said treatment fluid excess outlet is configured to drain a condensate excess.

8. The equipment according to claim 7, wherein said treatment fluid excess outlet is a purger.

9. The equipment according to claim 2, wherein said support structure includes casters.

10. The equipment according to claim 1, said temperature sensor configured to maintain a treatment temperature in the range of about 20° C. to about 120° C.

11. The equipment according to claim 2, wherein said control panel is configured to monitor at least one of: a rotating velocity of the rotatable treatment drum, a temperature, a moisture content inside the rotatable treatment drum, and a time of treatment.

12. The equipment according to claim 2, wherein at least one of the tubes is a coil for circulation of a treatment fluid.

* * * * *